United States Patent [19]

Foster et al.

[11] Patent Number: 4,674,820

[45] Date of Patent: Jun. 23, 1987

[54] REUSABLE JUNCTION BOX ELECTRICAL TERMINAL CAP

[76] Inventors: Shane M. Foster, 105 Granada, #2, Long Beach, Calif. 90803; Neil T. Foster, 1097 Santo Antonio, #38, Colton, Calif. 92324

[21] Appl. No.: 837,713

[22] Filed: Mar. 10, 1986

[51] Int. Cl.[4] ..... H01R 4/22

[52] U.S. Cl. ..... 439/522; 439/491; 174/52 PE

[58] Field of Search ..... 339/116 R, 116 C, 113 R, 339/113 B, 113 L, 263 R; 174/138 F, 65 R, 52 PE, 88 R, 88 S

[56] References Cited

U.S. PATENT DOCUMENTS

| | | | |
|---|---|---|---|
| 1,858,748 | 5/1932 | Paradis et al. | 339/116 R |
| 2,636,065 | 4/1953 | Fiske | 174/138 F |
| 3,240,979 | 3/1966 | Nicholson | 339/113 B |
| 3,775,730 | 11/1973 | Rowls et al. | 339/116 R |

FOREIGN PATENT DOCUMENTS

| | | | |
|---|---|---|---|
| 1396790 | 6/1975 | United Kingdom | 174/65 R |
| 2045546 | 3/1979 | United Kingdom | 339/113 R |
| 2133026 | 7/1984 | United Kingdom . | |

*Primary Examiner*—Gil Weidenfeld
*Assistant Examiner*—Thomas M. Kline
*Attorney, Agent, or Firm*—Stetina and Brunda

[57] ABSTRACT

A reusable cap encapsulates an electrical terminal in a junction box which routes communication lines such as phone wires. The cap includes a tubular body having a self tearing slot which receives a phone wire radially extending from a stud of a terminal. The cap also has an indicator knob having a pointed end which is angularly aligned with said self tearing slot. A technician can insert the cap over the terminal by aligning the indicator end of the knob with the phone wire, thereby aligning the self tearing slot with the wire. As the cap is inserted over the terminal, the wire penetrates and splits the self tearing slot. The cap is filled with a water impermeable elastic electrical insulating semi solid gel which encapsulates the terminal upon insertion of the cap. When the cap is removed, the gel is retained in the cap and cleanly pulls away from the terminal. A color coded indicator tab may be inserted onto the knob of the cap for indicating secured status of the phone wire.

7 Claims, 5 Drawing Figures

Fig. 1
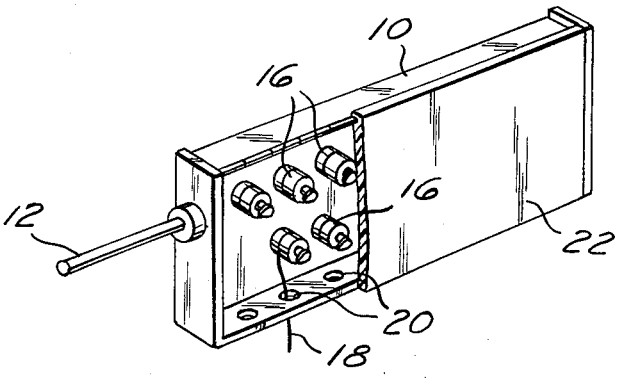
Fig. 2
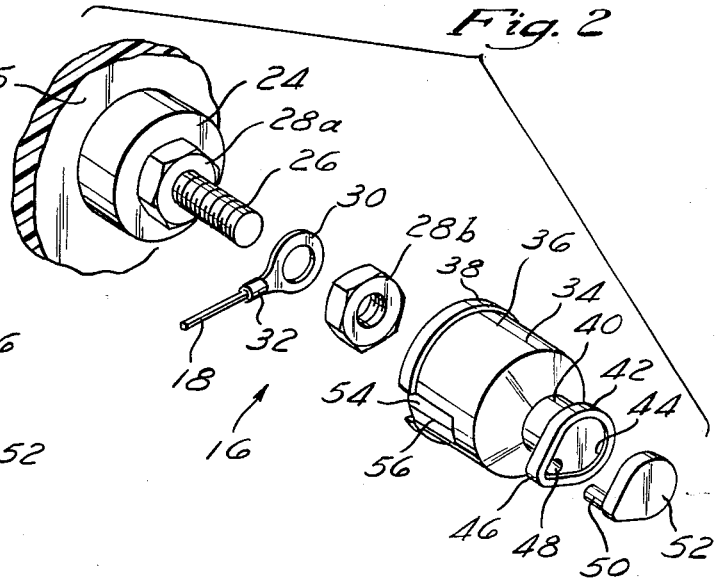
Fig. 3
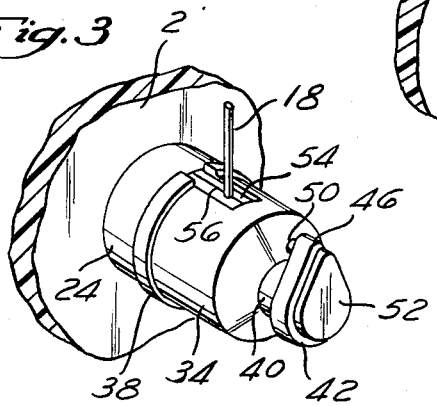
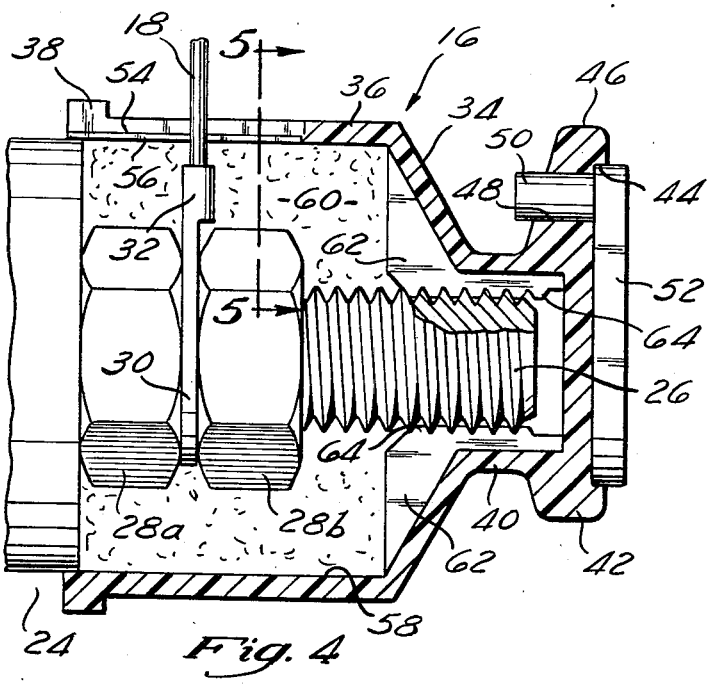
Fig. 4
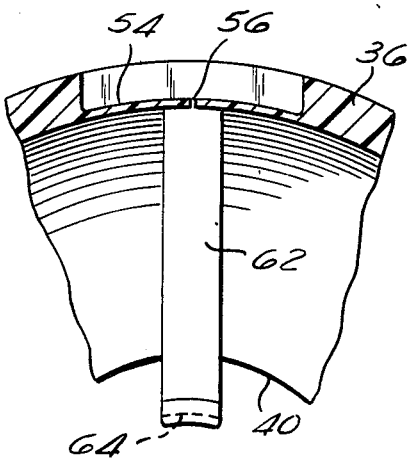
Fig. 5

REUSABLE JUNCTION BOX ELECTRICAL TERMINAL CAP

BACKGROUND OF THE INVENTION

The present invention relates generally to electrical junction boxes having a plurality of electrical terminals covered with protective caps and, more specifically, to water impermeable caps which encapsulate and protect the electric terminals located in telephone or other communication line junction boxes.

Junction boxes, typically located on telephone poles, have been extensively utilized in the prior art for rerouting telephone lines. Typically, a junction box has an incoming cable, which includes a plurality of individual telephone lines therein. The plural lines are routed to a pluarility of terminals located within the junction box. These terminals provide an access point for monitoring and routing individual phone wires to other phone connections external to the junction box.

The prior art junction boxes typically comprise a water resistant plastic or metal housing having a hinged front panel to provide access to a telephone wiring technician for monitoring and electrically configuring the phone wires extending individually from the terminals. The phone wires extending from the terminals to various external phone connections are routed through circular apertures in the junction box housing, which apertures typically include a water resistant webbing penetrable by the phone wires. The front panel and the webbing in the circular apertures provide moderate water resistance so as to prevent corrosion of the phone wires and terminals within the junction box.

As a further means to prevent corrosion of the terminals and the wires internal to the junction box, insulating caps have been used to cover the terminals. These prior art caps have included a tubular body which extends over the terminal to seat against the backplate or substrate of older junction boxes or surrounds the annular boss or more recent junction boxes from which extends the terminal stud and phone wire connection. As such, the prior art insulated terminal caps have been used in an attempt to prevent moisture from attacking the terminal preventing corrosion of the terminal.

Although the prior art caps have proven easily inserted onto a terminal threaded stud and as such have been an improvement over cumbersome electrical tape as a means to prevent corrosion, the caps have proven to be inherently leaky. In this regard, moisture penetrating through the moisture resistant junction box has often penetrated into the tubular body of the cap thereby attacking and corroding the terminal and phone wire.

In the prior art, it has additionally been common procedure to designate particular phone wires by color coded terminal caps indicating either that the line is secured or non-secured. Typically, a red color cap has designated a secure line. A secure line may be, for example, a computer line having data transmissions susceptible to electrical noise induced upon the line, for example, alarm phone lines which are used to signal an emergency condition which emergency condition might be inadvertently triggered by noise upon the line, and for example, emergency hospital lines which are used to communicate between emergency facilities. Communications over computer, hospital and alarm phone lines should not be interrupted by phone technicians monitoring the phone lines. To prevent interruption caused by possible monitoring by the technicians, the caps have been color coded "red" indicating a secure line so as to inform the technician that such line should not be monitored so as to prevent interruption of secured communications.

A significant problem associated with moisture leakage in the prior art terminal caps has been the poor seal resulting between the terminal caps and the backplate and/or boss of the terminal. The prior art caps have typically included an extremely thin tubular body providing insufficient rigidity, i.e. structural integrity to maintain a proper seal between the thin annular end of the tubular terminal cap and the backplate of the junction box. Additionally, due to the construction of the prior art terminal caps, the phone wire which extends from the terminal threaded stud heretofore has been required to be bent ninety degrees from the terminal threaded stud to extend axially toward the backplate or boss and subsequent, has then been bent another ninety degrees to extend radially away from the terminal threaded stud. Hence, the wire has been disposed between the backplate or boss and the annular end of the tubular body of the terminal cap. The wire so disposed has necessarily created spaces between the backplate and the end of the cap thereby providing undesirable access of moisture to the terminal threaded stud. Additionally, the bending of the phone wires has accelerated corrosion by virtue of fatigue at the bending points on the wire. In an attempt to alleviate this problem, it has been customary practice for technicians to manually slice or cut the tubular body of the terminal cap to allow the wire to extend directly radially outward from the terminal stud. However, this practice has resulted in further leakage problems since the thin tubular body of the cap would be further weakened and be incapable of supporting an encapsulate gel or forming a water tight seal.

Another problem associated with the prior art terminal caps has been the excessive inventory control required for multiple colored caps depending upon the differing types of lines, e.g., secured or unsecured lines. A different colored cap had to be inventoried for each type of line status. Inventory control and associated procurement activity for multiple colored caps necessarily has increased the expense of the caps.

Another problem associated with the prior terminal caps has been the necessity to change the cap in the event of a changed status of a particular line. When a line status is changed, e.g. from a secured line to a non-secured line, the cap necessarily had to be replaced, thereby subjecting the terminal to the environmental conditions and thereby accelerating possible corrosion of the temrinal.

Yet another problem associated with the prior terminal caps has been the use of non-reusuable moisture resistant hard cured substances disposed in the caps which, have tended to crumble or otherwise become non-reusable and defective. In the event that a line needed to be monitored necessitating the removal of the cap, the cap has thereby proven defective by virtue of the fracturing and crumbling of the water resistant substance inside the cap resulting in the discard and waste of the cap.

As such, the prior art terminal caps have possessed inherent problems and disadvantages, which problems or disadvantages are specifically reduced or solved using the present invention.

SUMMARY OF THE INVENTION

An object of the present invention is to provide for a water impermeable cap preventing moisture from attacking and corroding an electrical terminal.

Another object of the present invention is to provide an encapsulating terminal cap which is reusable.

Yet another object of the invention is to provide an encapsulating terminal cap whereupon installation upon the electrical terminal, excellent sealing between the terminal and the cap is achieved so as to prevent moisture from corroding the terminal.

Still another object of the present invention is to provide a single encapsulating terminal cap so as to minimize inventory control and expense associated with the use of differing encapsulating terminal caps.

A further object of the present invention is to provide an efficient means of changing line status indication without the need to remove and discard the existing terminal cap on the terminal.

Still a further object of the present invention is to provide for an indicator system upon the encapuslating cap so as to align the cap with the wire extending from the terminal so that a self tearing web or slot in a tubular body of the cap may be positioned over the wire and be torn upon insertion of the cap thereby eliminating the need to bend phone wires and/or manually cut the cap and thereby providing excellent sealing between the cap and the terminal.

Yet a further object of the present invention is to provide a reusable terminal cap in which is cured a water impermeable gel which adheres to the cap upon both insertion and removal of the cap but does not adhere to the terminal threaded stud of the terminal so that the gel is permanently retained within the terminal cap for subsequent reuse.

Another object of the present invention is to provide a wear resistant encapsulating cap which snugly fits onto the terminal threaded stud of the electrical terminal even after repeated reuse of the encapsulating cap.

More particularly, the present invention comprises a terminal cap for encapsulating electrical terminals in junction boxes; for instance, telephone and/or other communication cable junction boxes. The terminal cap includes a tubular body having an enlarged annular flange at one end for increased rigidity for maintaining an effective seal with the electrical terminal. A pear shaped knob is disposed at the other end of the terminal cap for manually manipulating the terminal cap, for aligning the cap with the terminal wire and for receiving an indicator tab. The knob includes a pointed end which is oriented to align with a reduced thickness web formed on the tubular body and extending upwardly from the annular flange. A self-tearing slot is provided at the center of the web adapted to be torn by the phone wire extending radially from the terminal threaded stud upon insertion of the terminal cap over the terminal.

A water impermeable preferably insulating gel is disposed within the tubular body, for encapsulating the electrical terminal. The gel maintains a semi-solid state over a wide ambient temperature range. Upon insertion of the terminal cap, the gel flows over and completely encapsulates the electrical terminal thereby protecting the electrical terminal from corrosive moisture and/or other adverse environmental debris such as dirt, insects, etc.

In use, a telephone technician manually inserts the cap over the terminal with the pointed end of the knob in alignment with the wire radially extending from the electrical terminal. As such, the self tearing slot and web is thereby also aligned with the phone wire. As the terminal cap is inserted upon the terminal, the wire extends through the tubular body at the exceptionally thin slot portion of the web, thereby tearing the web to accommodate the positioning of the wire. The wire, therefore, is not bent axially downward toward the backplate or boss of the terminal but rather extends radially outward from the terminal threaded stud. Hence, the wire is not bent and extends through the tubular body of the encapsulating cap.

As the terminal cap is inserted over the terminal, the water impermeable electrically insulating semi-solid gel flows over the terminal threaded stud, terminal nuts, and wire thereby encapuslating the terminal threaded stud and associated parts therein. The terminal cap is inserted to such an extent that the annular flange of the terminal cap extends over and surrounds the boss of the electrical terminal within the junction box or for older backplate junction boxes, directly abuts the backplate to form a seal thereagainst.

Pressure exerted upon the gel during penetration of the terminal threaded stud into the cavity of the terminal cap causes a small portion of the gel to extend or ooze through the self-tearing slot and web. The small portion of the gel and the self tearing slot completely surrounds the wire extending radially therethrough, thereby providing a leakproof seal at the self-tearing slot.

A pear shaped recess formed in the knob is suitably adapted to receive a color coded complimentary shaped indicator tab. The indicator tab is used to indicate the status of the line associated with the corresponding electrical terminals in the junction box. The changing of the status line may be accomplished merely by changing the indicator tab without removing the terminal cap from the terminal. Hence, a single inventoried cap may be used with differing indicator tabs. Generally, there is only one color necessary, that is, "red" for secure lines and this tab is relatively infrequently used in practice. Hence, a single cap is used with any number of indicator tabs providing for efficient inventory control of the tabs and the terminal caps.

The present invention encompasses an encapsulating terminal cap providing a water impermeable seal around the electrical terminal preventing corrosion of the terminal in moist environments. The present invention also provides for an efficient means to change the indicator tabs thereby efficiently changing the status of a line without removing the terminal cap and exposing the terminal threaded stud to moisture. These and other advantages will become more apparent in the following description of the preferred embodiment and the accompanying drawings.

BRIEF DESCRIPTION OF THE DRAWINGS

FIG. 1 is a perspective view of a junction box having a plurality of electrical terminals;

FIG. 2 is an exploded perspective view of an electrical terminal and a terminal cap;

FIG. 3 is a perspective view of an electrical terminal having the terminal cap disposed thereon;

FIG. 4 is a cross-sectional view of the electrical terminal having the terminal cap disposed thereon; and FIG. 5 is a detailed sectional view of the reduced thickness web with an exceptionally thin portion—a self tearing slot—formed at its center.

DETAILED DESCRIPTION OF THE PREFERRED EMBODIMENT

Referring to FIG. 1, a conventional modern telephone or other communication line junction box 10 is connected to an incoming cable 12 typically emanating from a main in line cable splice which, for purposes of illustration, comprises a plurality of phone lines (not shown) respectively connected to a plurality of electrical terminals 16. Each of the terminals 16 may have a radially extending phone wire 18 penetrating a circular aperture 20 in which is disposed a circular piece of water resistant webbing (not shown). The junction box 10 may have a hinged panel 22 which, when closed, provides for marginal moisture resistance and which partially prevents moisture from penetrating onto the terminals 16, which moisture has proven to cause corrosion of the terminals 16.

Referring to FIGS. 2 and 3, the terminal 16 typically includes a raised circular non-electrically conductive boss 24 extending from the backplate 25 of the junction box, having a threaded terminal stud 26 extending axially therefrom. Those skilled in the art will recognize however, that in the older junction box designs, the terminal stud 26 extends directly outward from the backplate 25 and the raised boss 24 is eliminated. Onto the threaded stud 26 is disposed one or more nuts or washers 28*a* and 28*b* which are used to securely clamp an electrical wire 18 onto the threaded stud 26.. The wire 18 may be provided with a lug 30 having a crimp portion 32 to securely crimp together the wire 18 and the lug 30 or alternatively the wire may be wrapped around the stud 26 in a conventional manner. Insertable over the terminal 16 is the terminal cap 34 of the present invention. The cap 34 is typically fabricated from an electrical insulator material such as nylon or other plastic material and includes a tubular body 36 and an annular flange 38 integrally formed at a distal end of the tubular body 36.

At a proximal end of the tubular body is an integrally formed neck 40 and a knob portion 42. The knob portion 42 is formed in a pear shaped configuration including a smaller complimentary pear shaped recess 44 positioned at the outer surface of the knob 42. The pear shaped knob 42 has a pointed end 46 as does the recess portion 44.

At the pointed end 46 of the recess 44 is an annular aperture 48 suitably adapted to receive a pin 50 extending from a pear shaped color coded tab 52. The color coded tab 52 may be, for example, formed in the color "red" indicating that a secure line is connected to the terminal 16. The tab 52 and the pin 50 are integrally formed and suitably sized so as to snugly fit and be retained in the recess 44 and aperture 48, respectively. The tab 52 is preferably formed to have a thickness sufficiently greater than the depth of the recess 44 so that technicians can manually insert and remove the tab 52 from the recess 44 with ease.

The cap 34 includes a reduced thickness web 54 which extends axially upward from the flange 38 in the center of which is located an exceptionally thin self tearing slot 56. The slot 56 is adapted to be self tearing, i.e. torn by the wire 18 upon insertion of the cap 34 onto the terminal 16. Upon insertion of the cap 34 over the wire 18, the web 54 moderately flexes outwardly about the wire 18 and the self tearing slot 56 splits as the wire 18 penetrates the self tearing slot 56. The inherent flexibility of the web 54 enables the web 54 to biasingly return toward this initial orientation and thereby conform to the wire 18 and snugly surround the wire 18. Although in the preferred embodiment the slit 56 is self tearing, those skilled in the art will recognize that the slit 56 can be fabricated in an open or spread configuration without departing from the spirit of the present invention.

The pointed end of the knob 52 is oriented to point toward the web 54 so that a technician when inserting the cap 34 onto the terminal 16, can easily visually align the wire 18 with the web 54 and self tearing slot 56 and ensure that the wire 18 properly penetrates the slot 56 upon insertion of the cap 34 upon the terminal 16.

Referring to FIGS. 4 and 5, the interior of the cap 34 includes a cylindrical cavity 58 into which is disposed a water impermeable non-toxic elastic preferably electrically insulating gel 60 possessing a semi-solid state through a wide ambient temperature range. Although differing gel compounds may be utilized, the gel 60 is preferably an electrical insulating material made of a Urethane compound manufactured by Synair Systems of Chattanooga, Tenn. marketed under the mark DUO-THANE SYSTEM 001, and possesses greater cohesion properties than adhesion properties so as to enable the same to be re-enterable, i.e. it pulls away cleanly from the terminal upon removal of the cap from the terminal and thus enables re-use of the cap 34.

With the structure defined, the use of the terminal cap 36 of the present invention may be defined. As the cap 34 is inserted onto the terminal 16 i.e. is extended axially downward over the terminal threaded stud 26, the gel 60 is displaced and flows over and conforms about the threaded stud 26, the nuts 28 and the wire 18 to thereby completely encapsulate the terminal 16 therein. As the gel 60 begins encapsulating or covering the terminal 16, the wire 18 begins to tear or split the self tearing slot 56 adjacent its lower end and moderately spreads the web 54 whereby the terminal threaded stud 26 extends up into the neck 40 of the cap 34. Equiangularly displaced struts 62 are positioned on the interior of the cap 34 to rigidify the neck portion 40 each of which includes a threaded or irregular surface 64 preferably formed to correspond to the thread pitch of the threaded stud 26. Continued axial downward movement of the cap 34 upon the terminal 16 causes the upper end of the threaded stud 26 to contact and be frictionally retained by the irregular surfaces 64 of the struts 62. The insertion continues until the flange 38 of the tubular body 36 extends over the boss 24 whereby the gel surrounds the boss 24 and the cap is firmly and snugly positioned onto the terminal 16. In this regard, the cap possesses sufficient structural integrity to maintain the gel about the terminal while the use of the rigidified flange 38 ensures a reliable positioning of the cap 34 upon the terminal 16. Alternatively, if the cap is utilized on the older non-boss backplate junction boxes, the flange 38 abuts the backplate 25 to form a positive moisture seal. The elastic properties of the nylon material used to manufacture the cap 34, permit the threaded stud 36 to be repeated inserted and removed from the cap 34 without substantial damage or wear of the irregular surfaces 64.

As will be recognized during insertion of the cap 34 over the terminal 16, the terminal 16 applies pressure upon the gel 60 causing the gel 60 to be displaced and flow over and encapsulate the terminal 16. In addition, a small portion of the gel 60 typically penetrates or oozes through the torn slot 56 to extend about the wire 18 while the web 54 subsequently biasly returns to its initial orientation. As such, the web 54 and slot 56 accomodates displacement of the gel 60 and provides a leakproof seal around the wire 18 at the torn slot 56, thereby further providing water impermeability and thereby preventing moisture contact with the terminal 16.

In the event that a technician wishes to monitor a phone line associated with the terminal 16, the technician slowly pulls the cap 34 by the knob 42 upwardly off of the terminal 16 which is then exposed. the gel 60, due to its inherent elastic and cohesive properties, slowly gelationusly pulls cleanly away from the terminal 16 typically leaving minimum or negligible gelatinous residue upon the terminal 16. The gel 60 then retracts to its original dispostion within the cavity 58 of the cap 34. Hence, the cap 34 is resuable i.e. re-enterable.

In the event that the status of a particular line has changed with the new status desired to be indicated by a different color code associated with a color coded tab 52 or the color code of the cap 34 which is black without a tab 52, a technician may easily remove an old color coded tab 52 and further may easily insert a new color coded tab 52. In this preferred embodiment, only non-secure and secure lines are indicated by a red tab 52 or a black knob 42 without a tab 52, respectively. In the case of a single status use, e.g. red for secured lines, only either the removal or insertion of the red color coded tab 52 is required.

It should now become apparent that by way of the present invention only one cap 34 configuration needs to be inventoried, that is a black nylon cap 34. It should equally be apparent that the cap 34 completely encapsulates the terminal 16 with a water impermeable gel 60, permanently disposed within the cavity 58 of the cap 34 with the annular flange end 38 providing greater structural integrity for the cap to maintain the gel about the terminal.

It should also become apparent that a waterproof encapsulating seal is provided by pressure upon the gel 60 upon insertion of the cap 34 onto the terminal 16, which gel 60 has a tendency to slightly minimally ooze out of the then torn slot 56 which was torn by the phone wire 18.

Further, it will be recognized that the wire 18 need not be initially bent axially toward the boss, and secondly bent radially outward away from the terminal threaded stud 64. In the preferred embodiment herein disclosed, the wire 18 need not be bent at all and may simply extend directly radially away from the terminal threaded stud 64. Thus, the wire 18 is not subjected to bending and fatigue associated with the prior art caps.

Even though those skilled in the art may conceive and invent differing encapsulating cap designs and modifications, those designs and modifications may nevertheless represent applications in principle within the spirit and scope of the present invention as defined by the following claims.

What is claimed is:

1. A cap for encapsulating a terminal having a substrate with an extending stud suitably adapted to receive a wire thereon comprising:

a tubular body having a distal end and a proximal end, said proximal end sized to surround said terminal;

a water impermeable gel disposed within said tubular body, said gel being semi-solid and elastic through ambient temperatures for conforming about said stud upon insertion of said cap onto said terminal;

self-tearing slot means for receiving said wire radially extending from said stud, said slot means extending from said proximal end of said tubular body toward said distal end of said tubular body;

said slot means comprising a reduced thickness web portion upon said tubular body adapted to be torn by said wire upon insertion of said cap upon said terminal;

indicator means formed on said distal end of said tubular body for indicating the position of said slot means; and a tab adapted to be removably attached to said indicator means to indicate the secure status of said wire associated with said terminal.

2. The cap of claim 1 further comprising a flange formed adjacent said proximal end of said tubular body, said flange formed to rigidify said tubular body.

3. The cap of claim 1 wherein said tab is color coded to indicate the secure status of said wire associated with said terminal.

4. The cap of claim 1 further comprising a plurality of struts disposed within said tubular body and sized to engage a portion of said terminal.

5. The cap of claim 1 wherein said plurality of struts are formed having a wear resistant surface for engagement with a portion of said terminal.

6. A cap for encapsulating terminals having a boss with an extending stud for interconnecting said terminal with a wire, comprising:

a tubular body having a distal end and a proximal end, said proximal end sized to cover said terminal;

self-tearing slot means for receiving said wire in said tubular body permitting said wire to be radially extended from said extending stud;

knob means connected to said tubular body at said distal end, said knob means having a pointer reference thereon for indicating the location of said self-tearing slot with said wire;

a color coded tab suitably shaped for attachment to said knob means for indicating the status of said wire;

said knob means including a pointed end, said knob means also including a recess, said recess having a corresponding pointed end and an aperture extending therethrough; and said color coded tab is shaped complimentary to said recess and includes a pin, said pin insertable through said aperture of said knob means.

7. The cap of claim 6 wherein said tubular body further comprises a neck portion disposed between said proximal end and said knob means, said neck portion having a plurality of struts within a cavity of said tubular body for supporting said neck portion, said struts having a wear resistant surface for engagement of threads of said terminal stud.

* * * * *